United States Patent [19]

Omley

[11] 4,073,423

[45] Feb. 14, 1978

[54] FURNITURE CLIP ATTACHMENT DEVICE

[75] Inventor: Herbert A. Omley, Wickenburg, Ariz.

[73] Assignee: Omley Industries, Inc., Wickenburg, Ariz.

[21] Appl. No.: 756,017

[22] Filed: Jan. 3, 1977

[51] Int. Cl.[2] ..... B27F 7/00

[52] U.S. Cl. ..... 227/7; 227/95; 227/153

[58] Field of Search ..... 227/2, 3, 5, 6, 7, 93, 227/95, 96, 100, 150, 153

[56] References Cited

U.S. PATENT DOCUMENTS

| | | | |
|---|---|---|---|
| 3,252,642 | 5/1966 | Page | 227/100 |
| 3,741,459 | 6/1973 | Arkush, Jr. | 227/3 |

*Primary Examiner*—Granville Y. Custer, Jr.
*Attorney, Agent, or Firm*—Warren F. B. Lindsley

[57] ABSTRACT

An automatic means for the attachment of spring clips to wooden frame members of furniture which clips serve in the attachment of springs to the frame. The clips are preformed in long coiled strips and are fed therefrom into a pneumatic driving tool which separates individual clips from the strip and drives their pointed ends into the frame members at controlled spaced intervals as the frame member is fed past the driving tool.

6 Claims, 22 Drawing Figures

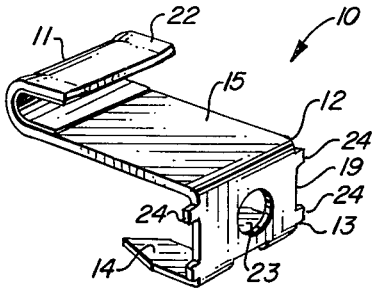
FIG. 1
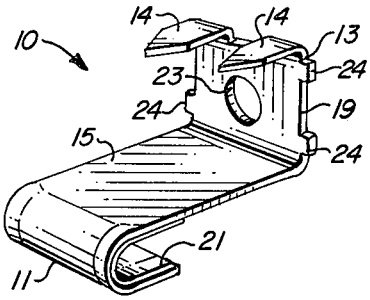
FIG. 2
FIG. 3
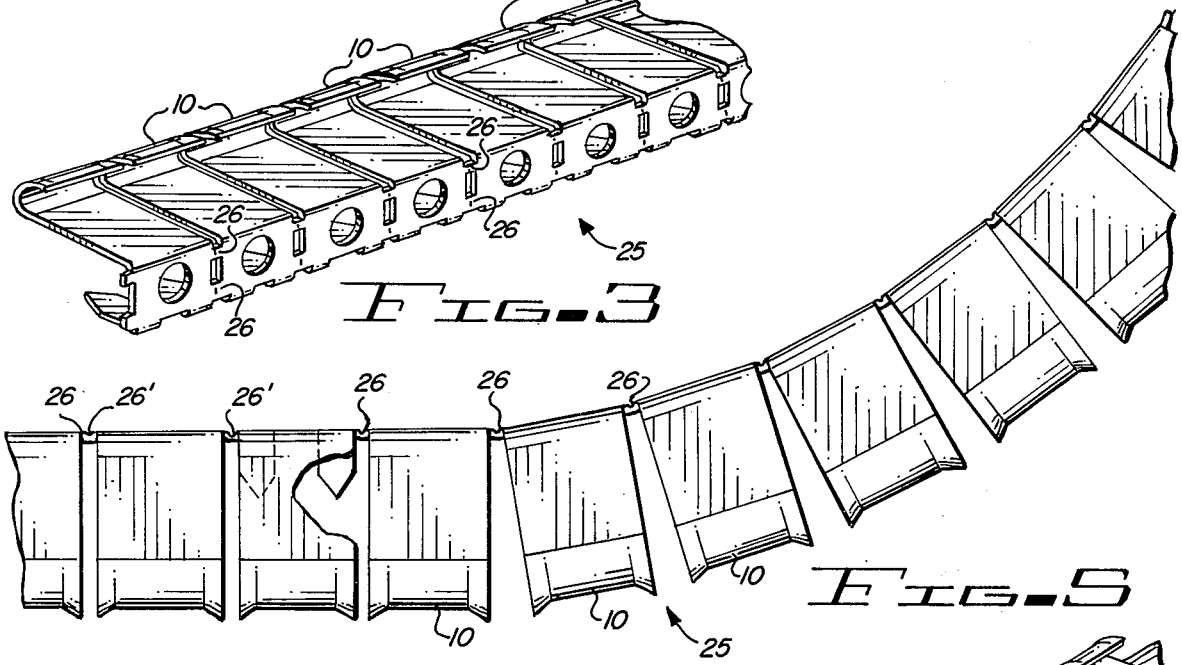
FIG. 5
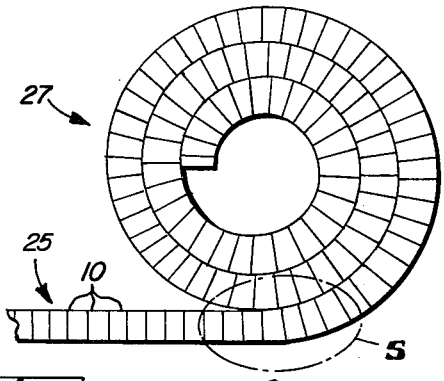
FIG. 4
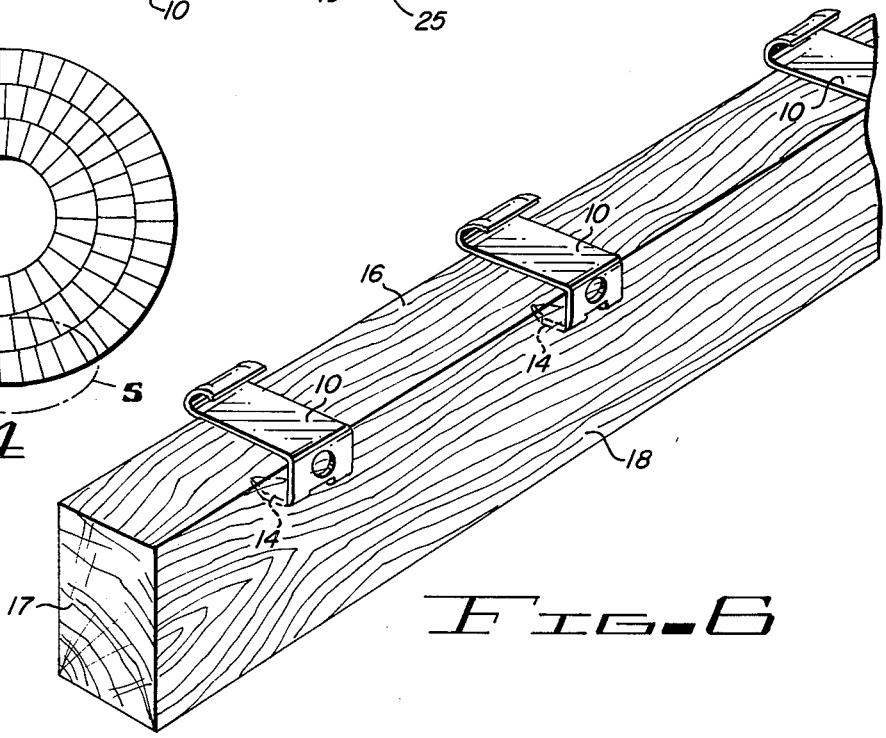
FIG. 6

FURNITURE CLIP ATTACHMENT DEVICE

BACKGROUND OF THE INVENTION

In the field of furniture construction, there is a continuing need on the furniture framework for spring attachment means. In the past, varous clip like devices have been used, generally comprising a bent portion with which to engage the spring and the remaining portion of the clip providing the base for attaching the clip to the framework of chairs, couches and other pieces of furniture. In most cases, the base of the clip is perforated with one or more holes through which securing means such as nails, screws or staples are passed for fastening the clip to the frame.

More recently, improved clip designs have been provided which eliminate the need for the additional hardware, i.e. nails, screws or staples by incorporating in the body of the clip its own means for being secured to the frame. Such a clip is described in U.S. Pat. No. 3,720,960 by J. J. Bond. Bond's clip utilizes a pair of sharp prongs formed at the end opposite the spring attachment end, the prongs being adapted to be driven into the wooden frame.

By eliminating the need for the additional hardware, the clip provided by Bond materially reduces the difficulty and time required for attaching the clip to the frame.

An improved version of the Bond clip is disclosed herein which is adapted for automatic attachment to wooden frame member.

In order to realize fully the potential advantages of such a clip, it is necessary to provide specially adapted equipment for automatic separation of the clips from their coil configuration and individual attachment of each clip to a frame member.

SUMMARY OF THE INVENTION

In accordance with the invention claimed, a specially adapted driving tool and associated equipment are provided for separating individual spring-support clips from a coiled strip and for driving them at controlled spaced intervals into wooden frame member of furniture as the frame members are fed past the equipment.

It is, therefore, one object of the present invention to provide an automatic device for use in the attachment of spring supporting clips to the wooden frame members of furniture.

Another object of this invention is to provide such a device in a form in which the clips are automatically secured to the frame members at the desired positions as the frame members are fed into or past the clip driving device.

A further object of this invention is to provide a specially adapted automatic driving tool for the shearing of individual clips from the strip and for sequentially driving them into a frame member.

A still further object of this invention is to provide a convenient means for controlling the positions along the length of the frame member at which the clips are attached thereto by the driving tool.

A still further object of this invention is to provide a means for securing the position of the wooden frame member during the shearing and driving of the clip.

A still further object of this invention is to provide for the storage and delivery of clips in strip form in accordance with the demands of the attachment operation.

A still further object of this invention is to provide means for preventing the driving mechanism from operating when a frame member is missing.

A still further object of this invention is to provide controls for insuring operation of the device to completion once it is initiated.

Yet another object of this invention is to provide a means for automatically resetting the control mechanisms following the removal of a frame member at the end of a clip attachment operation.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

FIG. 1 is a perspective view of a spring clip for attachment to a furniture frame member by an automatic device embodying the present invention;

FIG. 2 is a perspective view of the clip of FIG. 1 as viewed from a different angle.

FIG. 3 is a perspective view of a number of clips of FIGS. 1 and 2 interconnecting by fragile webs into a continuous strip of clips;

FIG. 4 is a representation of a strip of clips formed into a coil or roll which may be unwound as it is fed into an automatic machine for attachment to a furniture frame member;

FIG. 5 is an enlarged view of segment 5 of FIG. 4 showing a detailed plan view of a section of the coiled strip of clips;

FIG. 6 is a perspective view showing the clips of FIGS. 1 and 2 secured to a furniture frame member;

DESCRIPTION OF THE PREFERRED EMBODIMENT

Figure 7:
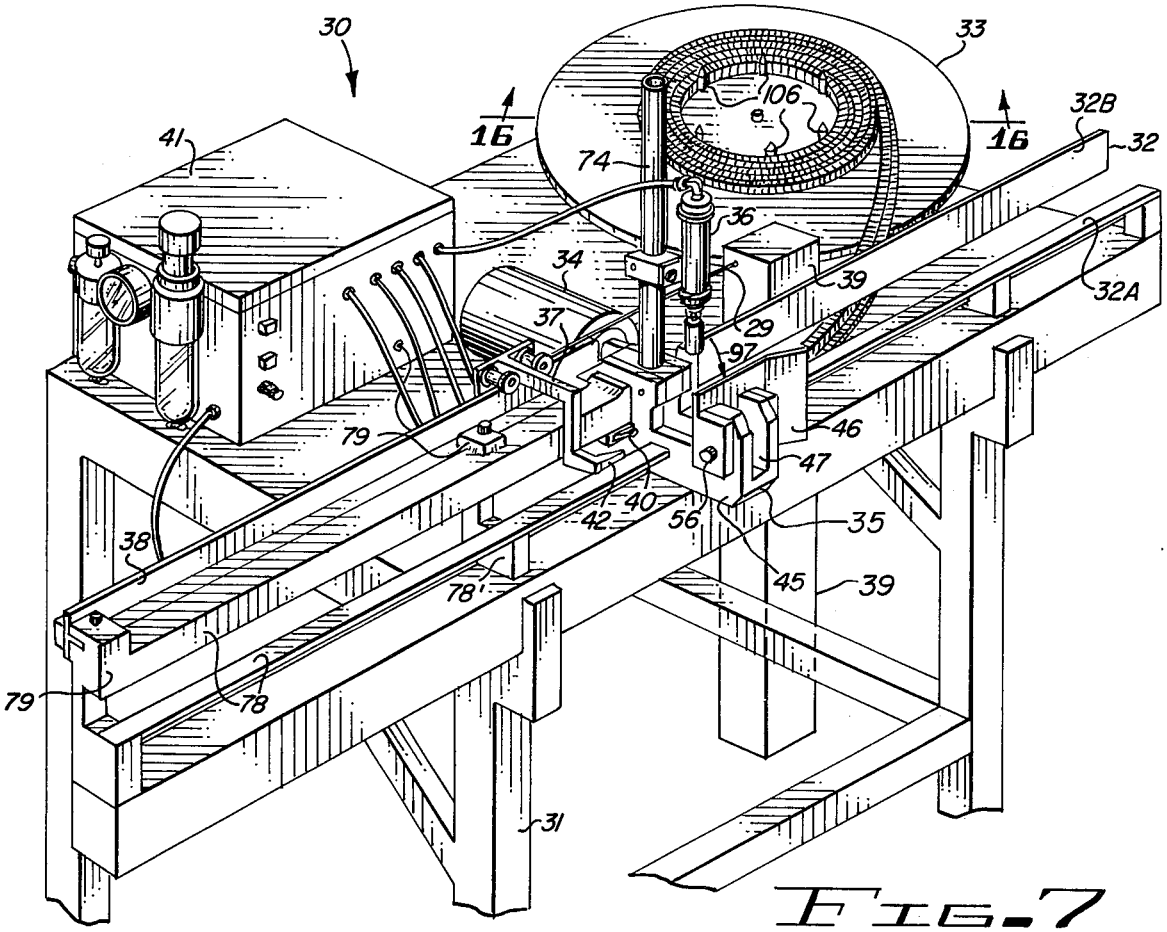
FIG. 7 is a perspective view of an automatic device embodying the features of this invention employed in the attachment of the clips of FIGS. 1 and 2 to a wooden frame member as shown in FIG. 6.
Figure 8:
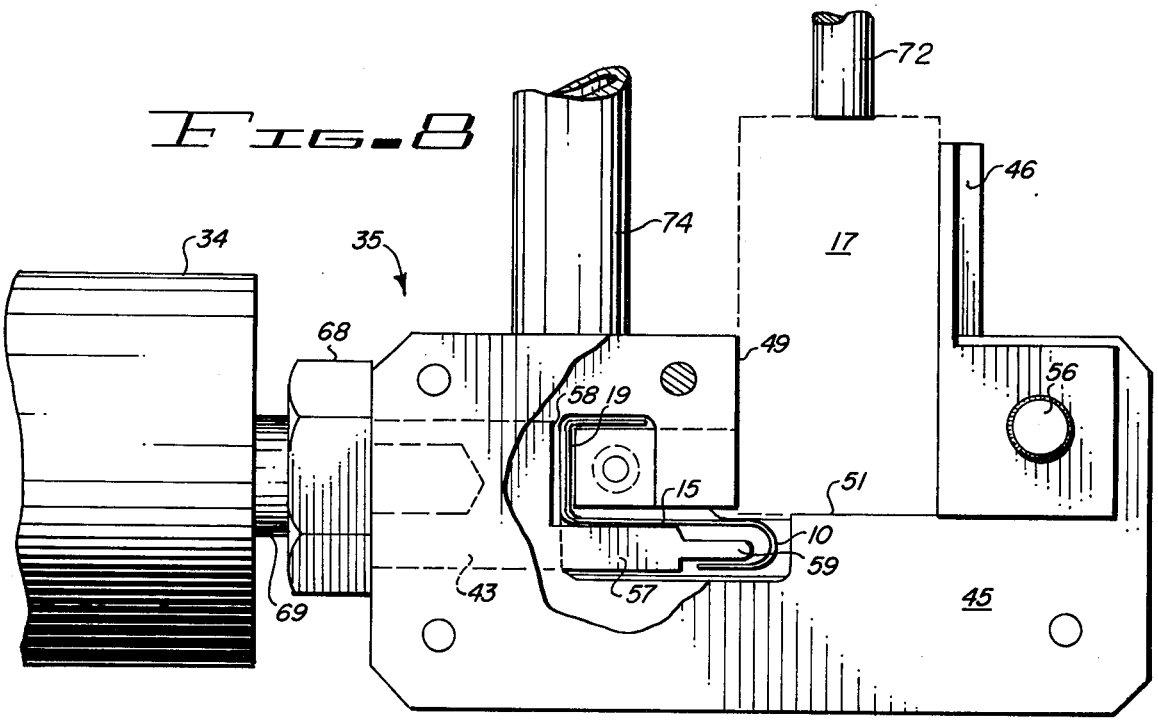
FIG. 8 is a side view of the clip driving mechanism shown in FIG. 7.

Referring more particularly to the drawing by characters of reference, FIGS. 1 and 2 illustrate a spring clip 10 of the type which is intended to be attached to a wooden frame member by the device of the present invention. Clip 10 is formed from a piece of sheet metal such as steel having one end 11 bent over on itself into a U-shaped configuration. The U-shaped end 11 of clip 10 is designed with a radius such that it will receive a spring of the type commonly employed as a resilient support in furniture such as chairs, sofas or the like, the spring usually being of a circular cross-section. The remaining portion of the sheet metal is bent 90 degrees at two points 12, 13 so that it too forms a U-shaped portion having square corners whereby the overall configuration of clip 10 may be thought of as representing an S-shaped device in profile. The outer leg 14 of the square-shaped U may be pointed or notched as shown. In operation base 15, defined as that portion of clip 10 comprising the common leg to both U-shaped portions and also defined as that portion generally aligned with the force exerted by the spring it is intended to secure, is also aligned with a top horizontal surface 16 of a furniture frame member 17 to which it is attached. Side 18 of member 17 is oriented to the outside of the furniture frame. The outside leg 14 is driven by an impact tool into frame member 17 until base 19 of the square-shaped U is in contacting relationship with side 18 of member 17 to act as a flange with respect to base portion 15. Clip 10 is thus firmly attached to frame member 17 by the two contacting sides 15, 19 and by the third embedded side 14. The clip is so designed that it cannot be pulled out of the frame.

Two other features of the configuration of clip 10 are nonfunctional in its end use, but they are involved in another important feature of the invention having to do with its fabrication and its automatic installation into a wooden frame member.

The first additional feature is a hole 23 in the center of side 19 which serves as a locator or registration hole for the fabrication of clip 10 in an automatic punch press. Hole 23 also may have utility in the proper positioning of clip 10 in an automatic installation device.

The second and more significant feature involves the four tabs 24, two of which are located on each of the outer edges of side 19. Tabs 24 are vestiges of the original fabricated form of clip 10. As illustrated most clearly in FIG. 3, clips 10 are mass-produced in a continuous strip 25. To those skilled in the art of punch press operation, it will be apparent that strip 25 may be readily produced by an automatic punch press. The individual clips 10 in strip 25 are held together by narrow webs 26. When the clips are later separated by an automatic device which also secures the clips in a wooden frame, the remnants of web 26 at each clip become tabs 24 of FIGS. 1 and 2.

The flexibility of strip 25 at web 26 permits the strip to be coiled into a roll 27 as shown in FIG. 4. For clarification of the axis about which the flexing occurs, an enlargement of section 5 of FIG. 4 is shown as FIG. 5. FIG. 5 is recognized as a top plan view of strip 25 from which it is apparent that the deformation of strip 25 is limited to the area of web 26.

FIG. 7 discloses an automatic attachment device 30 of the invention which is intended to attach clip 10 to the wooden frame member of a piece of furniture, as shown in FIG. 6. Device 30 comprises a supporting frame or table 31, a feed rail assembly 32, a clip reel 33, a ram cylinder 34, a cutting and driving mechanism 35, a clamping mechanism 36, a sensor car 37, a positioning rail 38, a cable return drive mechanism 39, a safety switch 40 and a control compartment 41.

In the utilization of device 30, the wooden frame member 17 of FIG. 6 to which the clips 10 are to be attached is placed lengthwise at the right-hand end of feed rail assembly 32, its narrow surface 16 resting on lower horizontal rail member 32A and its broader surface 18 held against vertical side rail member 32B or vice versa. Starting from this position the frame member 17 is moved leftwardly along rail assembly 32 through an opening in the cutting and driving mechanism 35 until its leading end closes safety switch 40 and makes contact with a retaining means 42 attached to sensor car 37. As the frame member 17 continues to advance leftward from this point it drives retaining means 42 and car 37 leftward also, the car 37 being carried by positioning rail 38 which runs parallel to feel rail assembly 32. At a predetermined position along rail 38 contact fingers carried by car 37 short out a pair of electrically conductive strips attached to the far side of rail 38 and thereby initiate a clip attachment operation which involves the clamping of the wooden frame member 17 in position and the actuating of the shearing and driving mechanism 35 which is driven by ram cylinder 34. In the process of this operation, a supply of clips 10 has been fed to mechanism 35 as a continuous connected strip 25 unwinding from a coil or roll 27 carried by reel 33. When the finished frame member 17 is removed, car 37 is returned to its starting position by mechanism 39 to which it is attached by a cable 29.

The foregoing simplified explanation of the operation of device 30 will be better understood when considered in conjunction with the following descriptions of its components.

FIGS. 7, 8, 9 and 10 illustrate the shearing and driving mechanism 35 which comprises a ram 43, a fixed frame 45 and an adjustable back-up plate 46.

As may be seen from FIG. 7, frame 45 is in the general form of a channel opening upward, the rearward portion of this opening 47 providing clearance for the travel of ram 43. A transverse rectangular opening also opening upward provides clearance for the wooden frame member 17 as it is moved through mechanism 35. The rearward vertical surface 49 of the transverse opening is aligned with the forward surface of vertical feed rail member 32B and the lower horizontal surface 51 of the transverse opening is aligned with rail 32A.

The width of the transverse opening is adjustable by means of backup plate 46 which is secured to frame 45 by a set screw 56.

Ram 43 serves in both the shearing and driving operations. Its cross-section is generally rectangular and a contoured finger 57 projects forward from its lower forward surface. The rounded leading edge 59 of finger 57 is dimensioned to fit inside U-shaped end 11 of clip 10. The length of finger 57 corresponds to the length of base 15 of clip 10 so that when finger 57 is nested inside U-shaped end 11 of clip 10, base 19 of clip 10 rests against the forward vertical face 58 of ram 43. The far edge of surface 58 of FIG. 9 which is also seen as the corner 61 in FIG. 10 serves as a first cutting edge for the shearing operation.

Figure 18:
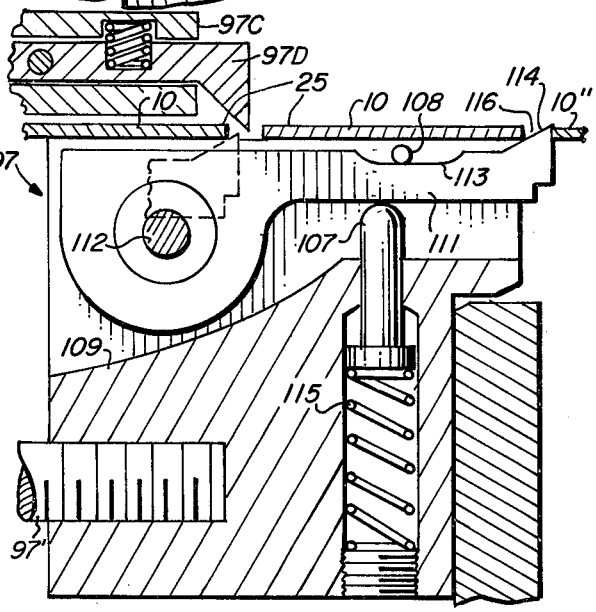
FIG. 18 is a cross-sectional view of the clip-advancement mechanism employed in the device of FIG. 7, FIG. 19 comprises a partial perspective view of the clip advance mechanism.
Figure 19:
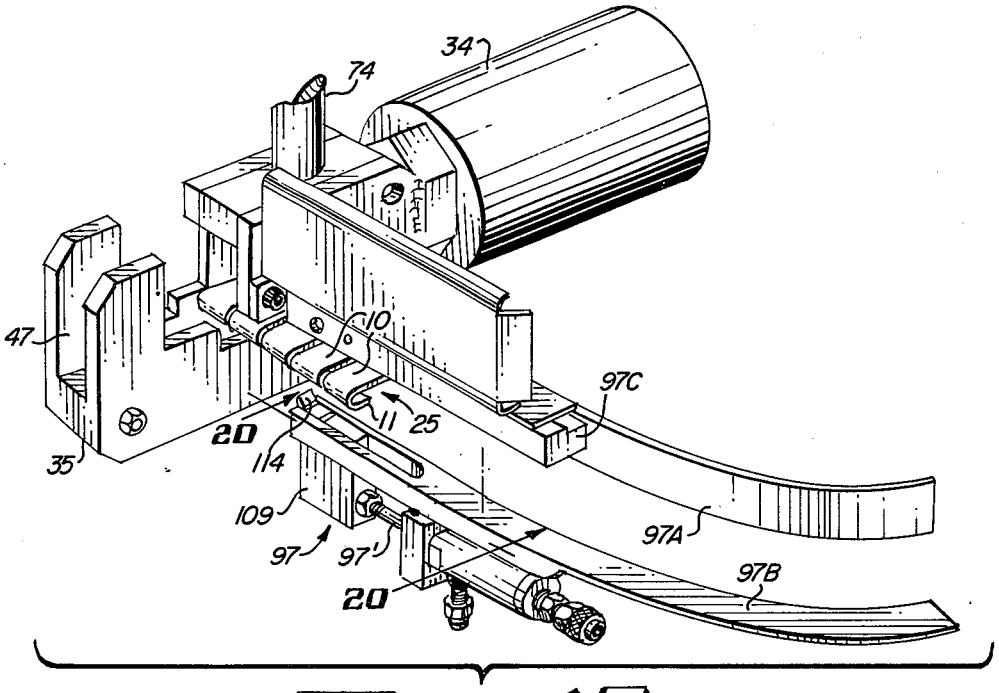

Cooperating with ram 43 in the shearing operation is a shear block 62 which is mounted by means of a flat bracket 63 to a downward projection 45A which is an integral part of the far vertical side of frame 45. The lower end of projection 45A terminates just above finger 57 of ram 43 so that a passage remains therebetween for clips 10 to be fed to finger 57 from the far side. The shear block 62 is a rectangular block of hardened steel having four sides and two ends resulting in a six-sided structure. As shown in FIGS. 18 and 19, a clip control block 97C is mounted above the strip of clips 25 between rails 97A and 97B which has a pivotally mounted finger 97D which is spring biased into engagement with the strip of clips 25 for engaging the slot 116 between the clips to keep them from retrograde movement in a known manner. It is secured to one surface of bracket 63 by means of a screw 64. The same surface of bracket 63 is secured against the outside surface of projection 45A by two additional screws 65. The dimension of block 62 and projection 45A are such that surface 67' of shear block 62 is approximately coplanar with the far vertical side 66 of block 62' but with adequate offset for clearance when ram 43 moves forward past shear block 62. The shearing action occurs as edge 61 of shear block 62' moves past edge 67 of shear block 62, at which time webs between clip 10 and the next clip in strip 25 are severed.

Figure 9:
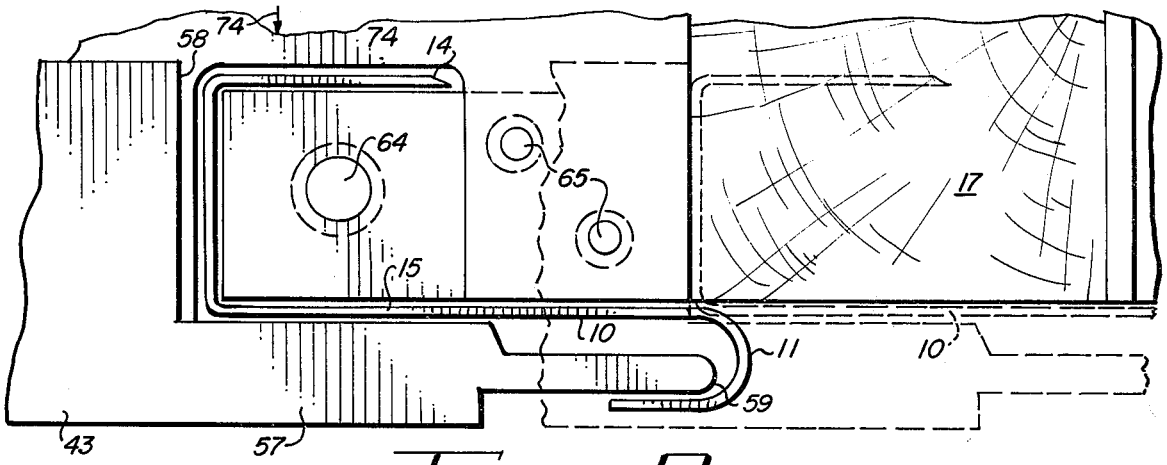
FIG. 9 is an enlargement of a portion of the driving mechanism of FIG. 8.
Figure 10:
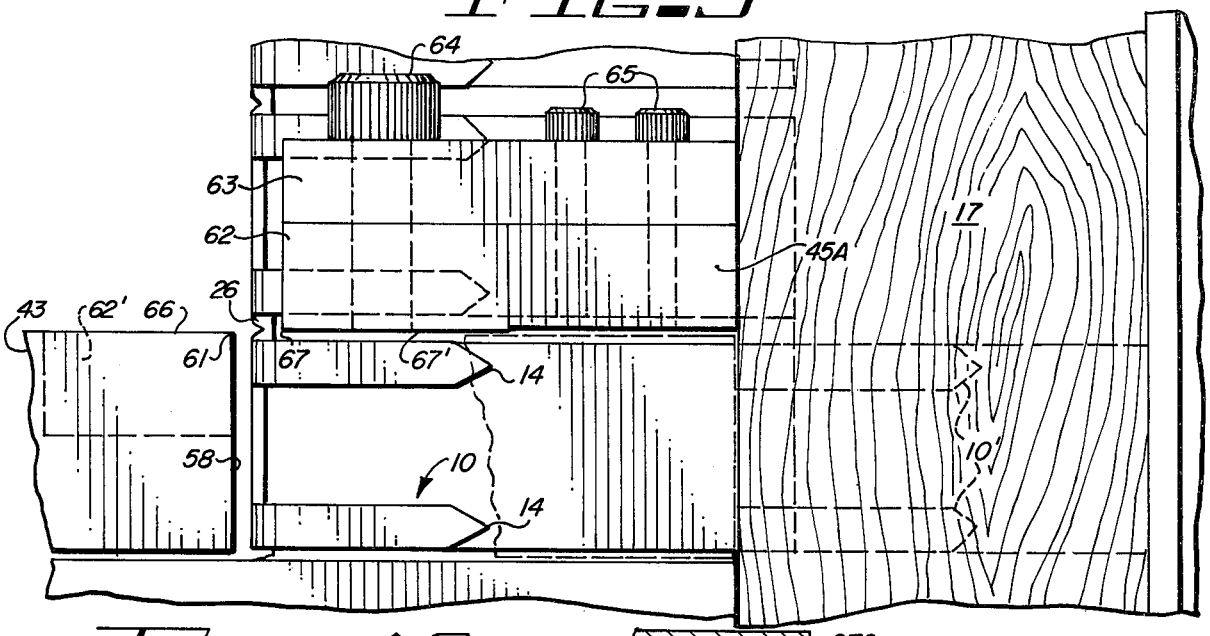
FIG. 10 is a top view of the portion of the driving mechanism shown in FIG. 9.

As the shearing action is completed ram 43 continues its forward stroke carrying the separated clip 10 to the right in FIGS. 9 and 10 and driving its pointed legs 14 into the wooden frame member 17 as indicated by the broken-line representations, 10'.

During the shearing and driving operation the wooden frame member 17 is held in position by the back-up plate 46 and by the clamping mechanism 36. The back-up plate 46 is secured as already indicated to frame 45 and frame 45 is attached by means of nut 68 to ram cylinder 34, nut 68 being brazed or welded to frame 45 and threadably attached to the throat 69 of cylinder 34. This direct mechanical coupling of plate 46 to cylinder 34 permits frame 45 to serve a back-up function against frame member 17 against the action of ram 43. At the same time, the lateral motion of frame member 17 along rail 32 is prevented by mechanism 36.

Figure 11:
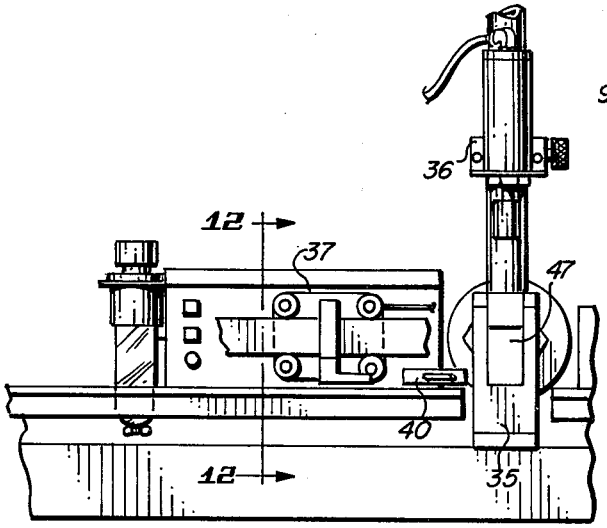
FIG. 11 is an enlarged view of a portion of the device of FIG. 7 showing an end view of the clip driving mechanism of FIG. 8 and a side view of the sensor car which participates in the location of the clip attachment positions along the length of the wooden frame member.
Figure 15:
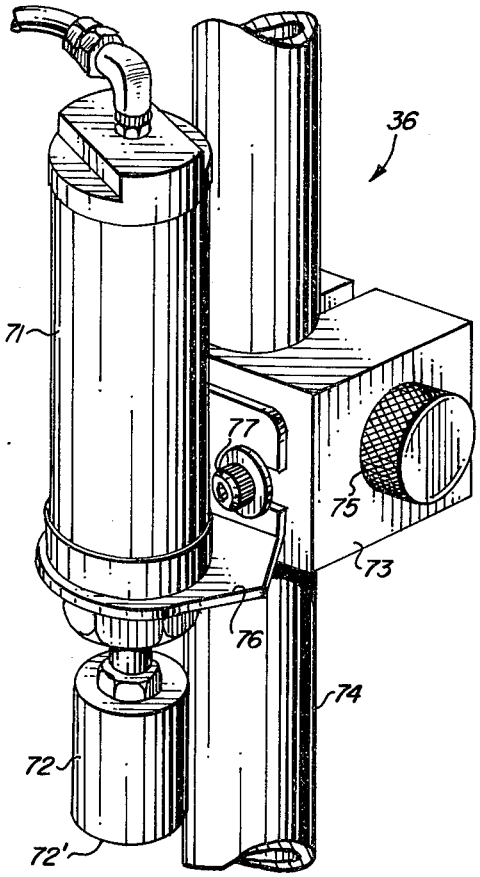
FIG. 15 is a perspective view of the clamping mechanism.

As shown in FIGS. 11 and 15, clamping mechanism 36 is comprised of a pneumatic drive cylinder 71, a plunger 72, an adjustable supporting clamp 73 and a support post 74. Post 74 is a vertical tubular cylindrical support and is attached to the top rear surface of frame 45. Clamp 73 is a rectangular block with a cylindrical opening that slips over post 74. A slot in the block along one side of the cylindrical opening is partially closed by means of a clamping screw 75 which secures clamp 73 at any desired level on post 74. A support bracket 76 integral with cylinder 71 is attached by means of screws 77 to clamp 73. By this means cylinder 71 and plunger 72 are vertically mounted directly above frame member 17 with plunger 72 directed downward so that when the pressure is raised in cylinder 71, the hard rubber tip 72' of plunger 72 is forced against the top of member 17 to prevent any lateral movement during the shearing and driving operation.

Cooperating in the automatic location of clips 10 at the desired positions along the length of frame member 17 and in the automatic initiation of the shearing and driving operations are the sensor car 37 and the positioning rail 38 as shown in FIGS. 7, 11, 12, 13 and 14.

Figure 13:
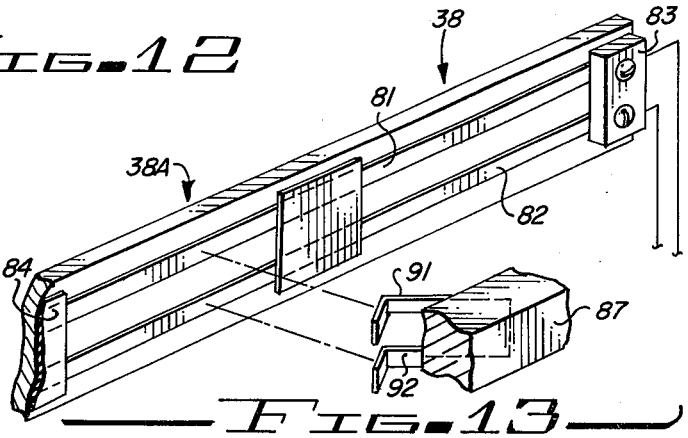
FIG. 13 is a partial perspective view of the positioning rail and sensor finger assembly.

Rail 38 has a cross-section in the form of a "T" rotated 90° so that the cross-bar becomes a vertical rail 38A and the perpendicular trunk becomes a stiffening rib 38B. Rail 38 is supported by a rigidized extension 78 of rail 32A on the discharge side of shearing and driving mechanism 35, rib 38B being gripped at two or more points by projections 79 of extension 78. On the face of rail 38A opposite rib 38B two parallel conductors 81 and 82 run the length of rail 38. Conductors 81 and 82 are insulated from rail 38 and are attached thereto by insulator blocks 83. At intervals along the length of rail 38 corresponding to the desired placement of clips 10 along the length of wooden frame member 17 are rectangular insulating strips 84. Except for the areas of strips 84 the outside conducting surfaces of the conductors 81 and 82 are exposed as shown in FIG. 13.

Figure 12:
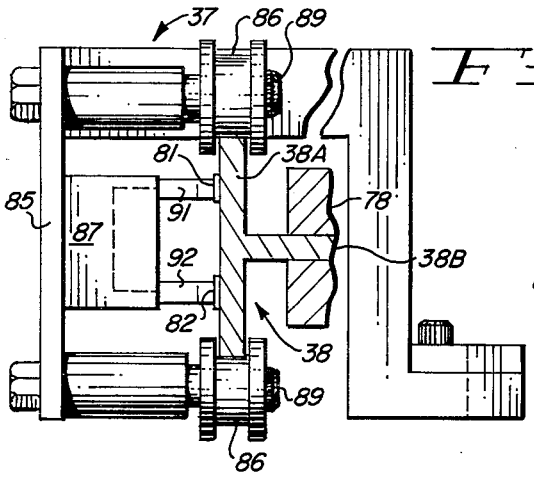
FIG. 12 is an end view of the sensor car and positioning rail.
Figure 14:
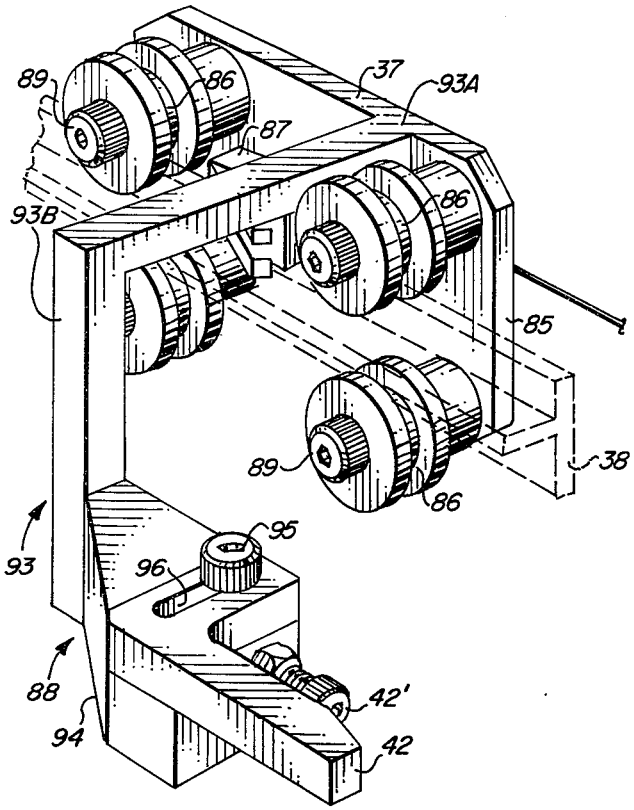
FIG. 14 is an enlarged perspective view of the sensor car.

The sensor car 37 as shown most clearly in FIGS. 12 and 14 comprises a main support plate 85, four grooved wheels 86, a sensor block 87 and a probe assembly 88. The main support plate 85 is roughly rectangular, its greater dimension running horizontally and its lesser dimension running vertically. The four wheels 86 are supported by four horizontal axles 89 symmetrically attached near the four corners of plate 85 so that two pairs of the wheels 86 are provided, one wheel of each pair located directly above the other and one pair located at each end of plate 85. The vertical spacing between the two wheels of each pair is such that the rail 38A may be snugly captured between the bases of the grooves of the upper and lower wheels 86 of both pairs of wheels as indicated in FIG. 12. When mounted thusly to rail 38A, the car 37 is supported by rail 38A in a manner similar to the support of a monorail vehicle, complete freedom being afforded for motion along the length of the rail, but positive restraint being provided against the car becoming disengaged from the rail. The sensor block 87 is attached to the center of plate 85 in the same side as wheels 86, which side also faces conductors 81 and 82 attached to the opposing face of rail 38A. Supported by block 87 are two conductive metallic brushes 91 and 92 appropriately dimensioned and oriented such that brush 91 makes electrical contact with conductor 81 and brush 92 makes electrical contact with conductor 82 as car 37 moves along rail 38A. Brush 91 is electrically connected to brush 92 so that while brushes 91 and 92 are in contact with conductors 81 and 82 the two conductors 81 and 82 are electrically connected together or "shorted" by brushes 91 and 92. As car 37 moves along the rail, however, brushes 91 and 92 will pass over insulators 84 and during such passage the electrical connection between conductors 81 and 82 is broken.

Probe assembly 88 is attached to plate 85 by means of an L-shaped cantilever support 93, the first leg 93A of support 93 being attached perpendicularly to the side of plate 85 on which wheels 86 and block 87 are mounted. The second leg 93B of support 93 extends vertically downward from the outer end of the first leg. The probe assembly 88 is mounted at the lower end of the second leg 93B of support 93. Assembly 88 comprises a support block 94 with retaining means 42 attached thereto by means of a screw 95 passing through a slot 96 in the base of retaining means 42 which permits a lateral adjustment of the position of the retaining means 42 in terms of its horizontal displacement from extension 78 of rail 32.

It will now be appreciated that as wooden frame member 17 emerges from the discharge side of the cutting and driving mechanism 35 its emerging end will engage probe 42' adjacent the tip of the retaining means 42 and will thus move car 37 along rail 38A as described earlier, making and breaking electrical contact between electrical conductors 81 and 82 and over insulating strips 84.

Figure 16:
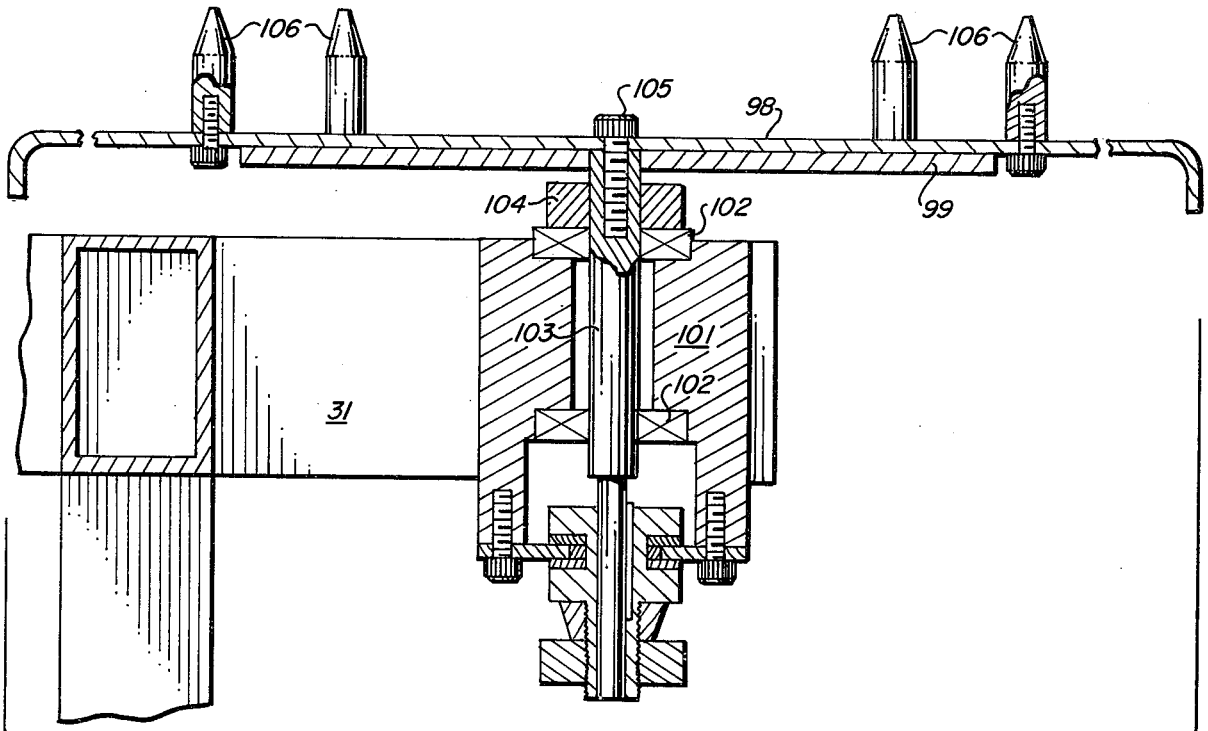
FIG. 16 is a cross-sectional view taken on line 16—16 of FIG. 7 of the reel assembly which stores and dispenses the coiled strips of clips.

Delivery of clips 10 to mechanism 35 is accomplished through the cooperation of reel 33 as shown in FIGS. 7 and 16 and a clip advance mechanism 97 as shown in FIGS. 18–21B.

Reel 33 comprises a horizontal circular disc 98 stiffened by a circular back-up plate 99 pivotally mounted to table 31 by means of a pillow block 101, ball-bearings 102, a shaft 103, and a shaft collar 104. Disc 98 is attached to shaft 103 by means of a cap screw 105. Arranged in a circle symmetrically about the center of the top surface of disc 98 at a radius approximately one-half the full radius of disc 98 are six or more pointed pegs 106 projecting upward from the top surface of disc 98. Pegs 106 serve as a form about which coiled strip 25 of clips 10 is wound as shown in FIG. 7.

Figure 20:
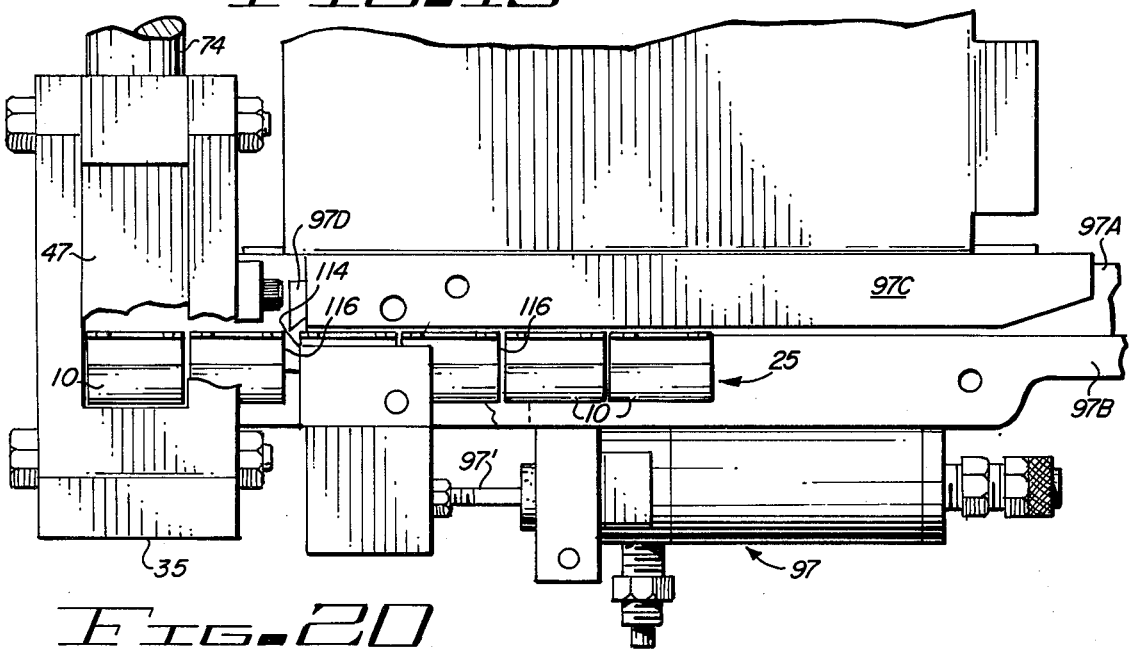
FIG. 20 is a cross-sectional view of FIG. 19 taken along the line 20—20.
Figure 21A:
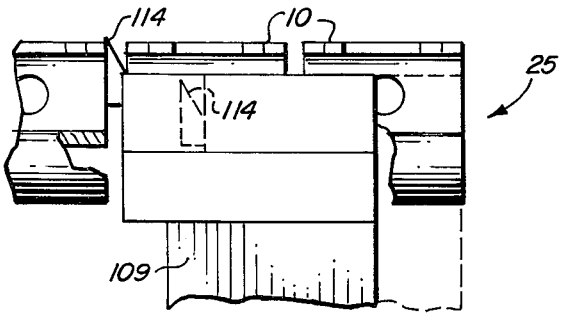
FIG. 21A is an enlarged partial view of FIG. 20 of the clip advance mechanism showing two portions of the tip of the clip advance finger.
Figure 21B:
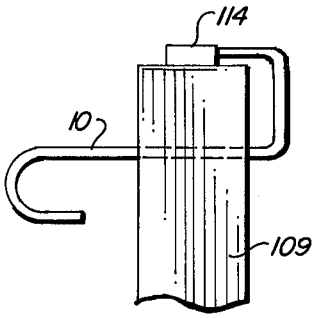
FIG. 21B is an end view of the clip advance mechanism showing the tip of the finger in pushing contact with the strip of clips.

As strip 25 peels off reel 33, it passes through a channeled guided arrangement, and comprising rails 97A and 97B shown in FIGS. 19 and 20 and is engaged by the clip-advance mechanism 97 of FIGS. 18 and 19. Clip advance mechanism 97 comprises a vertical spring loaded pin 107, a horizontal pin 108, a frame 109, and a pivoting finger 111. Finger 111 is generally horizontal, extending to the right from a pivotal support 112 at the left end. The top edge or surface of finger 111 is flat except for a curved depression 113 just inboard of the right-hand end and except for an inclined raised tip 114 at the right-hand end. The strip 25 of joined clips 10 is positioned horizontally above finger 111. Pin 107 is located below finger 111 and is captured within a vertical bore above a coil spring 115 which urges it upward driving its tip against the flat underside of finger 111 so that the top of finger 111 is driven against the underside of strip 25, strip 25 being constrained against moving upward by a guide rail 97A shown FIGS. 19 and 20 in the drawing. To operate mechanism 97, pivotal support 112 is driven horizontally from left to right and back again in a continuous cyclic action by an air cylinder employing a piston rod 97'. As tip 114 is moved from left to right, it will be driven upward into gap 116 between adjacent joined clips 10 so that strip 25 is thereby engaged and driven to the right shown in FIG. 18 and to the left shown in FIGS. 19 and 20 during the remaining rightward travel of finger 111. As pivotal pin 112 is then driven horizontally leftward, the inclined upper surface of tip 114 disengages from gap 116 and strip 25 remains stationary until finger 111 is again moved to the left and tip 114 again engages strip 25 at another gap 116. Pin 108 limits the upward travel of finger 111 when the end of strip 25 has passed into mechanism 35. Thus, for example, if clip 10'' is the last clip, pin 108 riding in depression 113 holds finger 111 at a vertical level which insures that tip 114 properly engages the trailing edge of clip 10''.

Figure 17:
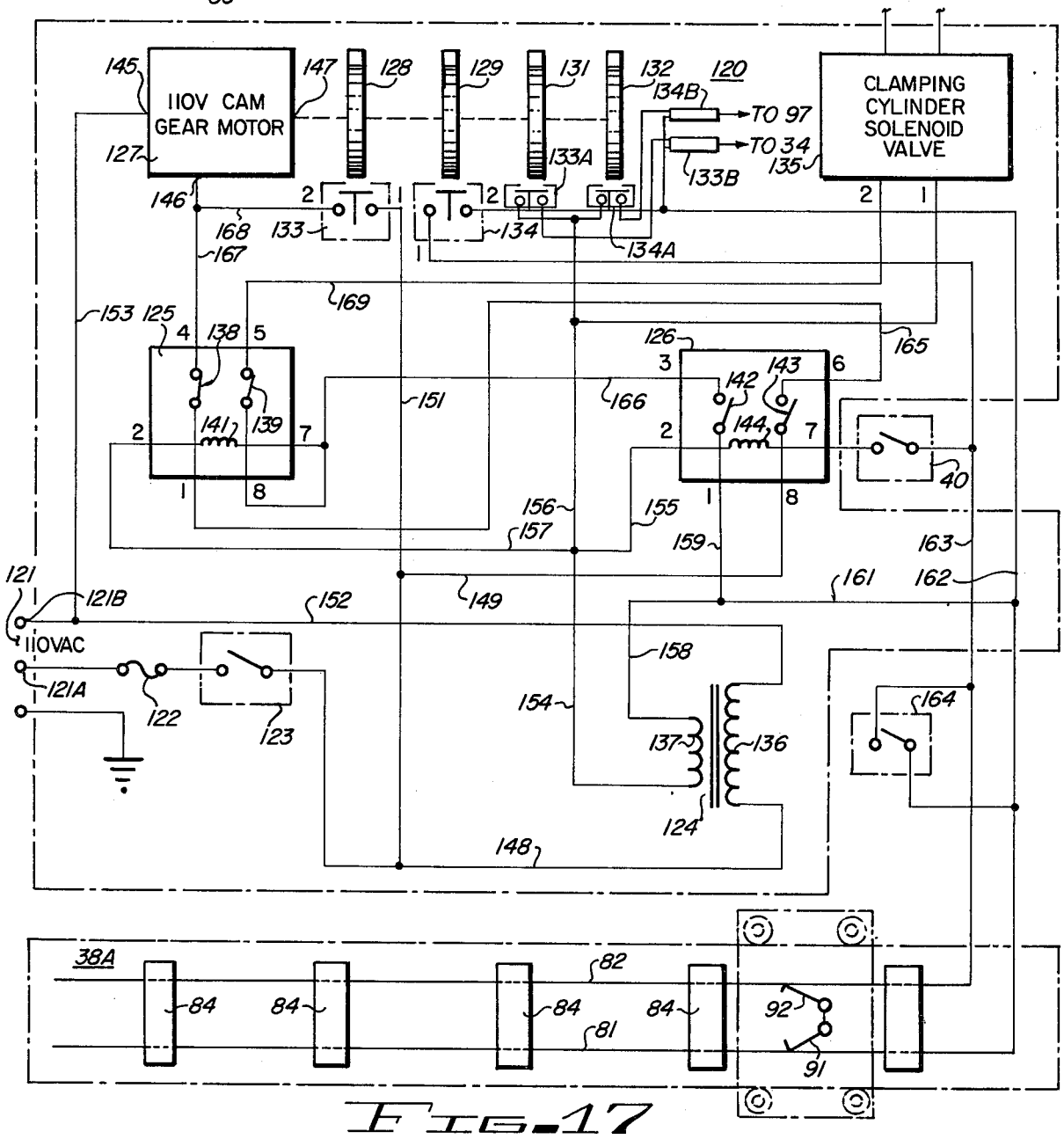
FIG. 17 is a diagrammatic representation of the electrical and mechanical control system of the device of FIG. 7.

To render device 30 fully operational in terms of its automatic operation, an electro-mechanical control system 120 is provided as shown diagrammatically in FIG. 17. System 120 is housed in control compartment 41.

Control system 120 comprises a power source 121, preferably 110 volts a-c, a line fuse 122, a POWER ON/OFF switch 123, a step-down transformer 124, a time-delay relay 125, a second relay 126 without the delay characteristic, a 110 volt gear motor 127 coupled to cams 128, 129, 131, and 132, cam-operated switches 133 and 134, and clamping cylinder solenoid valve 135.

Transformer 124 has a 110 volt primary winding 136 and a 24 volt secondary winding 137.

Relay 125 has two normally closed contacts 138 and 139, a coil 141, and terminals 1, 2, 4, 5, 7 and 8. Contact 138 is connected betweed terminals 1 and 4, contact 139 is connected between terminals 5 and 8, and coil 141 is connected between terminals 2 and 7. When coil 141 is not energized, contacts 138 and 139 are closed as shown. When coil 141 is energized by the application of 24 volts across terminals 2 and 7, contacts 138 and 139 remain closed through a time delay period of approximately 0.6 seconds and then open. They then remain open as long as coil 141 remains energized.

Relay 126 has two normally open contacts 142 and 143, a coil 144 and terminals 1, 2, 3, 6, 7 and 8. Contact 142 is connected between terminals 1 and 3, contact 143 is connected between terminals 6 and 8, and coil 144 is connected between terminals 2 and 7. Contacts 142 and 143 are open when coil 144 is not energized and they close when coil 144 is energized.

Motor 127 operates when 110 volts a-c is applied across its input terminals 145 and 146. Its output shaft 147 carries the four cams 128, 129, 131 and 132. Shaft 147 rotates at approximately one revolution per second, and during each revolution cams 128 and 129 close switches 133 and 134, respectively, for 0.8 seconds.

A first terminal 121A of source 121 is connected through fuse 122, switch 123 and line 148 to the first side of primary winding 136. Terminal 121A is also connected through fuse 122, switch 123 and lines 149 and 151, respectively, to terminal 8 of relay 126 and terminal 1 of switch 133. The second terminal 121B of source 121 is connected by line 152 to the second end of primary winding 136 and by line 153 to terminal 145 of motor 127.

A first end of secondary winding 137 is connected by lines 154, 155, 156 and 157 to terminal 2 of relay 126, terminal 1 of valve 135, and terminal 2 of relay 125. The second end of secondary winding 137 is connected by lines 158, 159 and 161 to a first bus 162 and terminal 1 of relay 126.

Terminal 7 of relay 126 is connected through safety switch 40 to a second bus 163. Busses 162 and 163 are connected to conductors 81 and 82, respectively, of rail 38A. Also connected across busses 162 and 163 are cam operated switch 134 and a sensor bypass switch 164.

Terminal 6 of relay 126 is connected by line 165 to terminal 1 of relay 125. Terminal 3 of relay 126 is connected by line 166 to terminals 7 and 8 of relay 125. Terminal 4 of relay 125 is connected by lines 167 and 168 to terminal 146 of motor 127 and terminal 2 of switch 133, and terminal 5 of relay 125 is connected by line 169 to terminal 2 of valve 135.

In the operation of control system 120, switch 123 is first closed to apply power to primary winding 136 of transformer 124. A frame member 17 is then placed on rail 32 and moved through mechanism 35. As the leading edge of member 17 emerges at the discharge side of mechanism 35 or enters the mechanism as an alternative way it actuates (closes) switch 40, then makes contact with probe 42 and drives car 37 leftward until brushes 91 and 92 make contact with conductors 81 and 82, respectively, and thereby make a direct electrical connection between conductors 81 and 82 and hence between busses 162 and 163. When this occurs, the second side of secondary winding 137 is connected through lines 158, 161, bus 162, brushes 91 and 92, and safety switch 40 to terminal of relay 126 so that coil 144 is now directly connected to secondary winding 137 and is energized at 24 volts a-c. Contacts 142 and 143 close immediately, causing terminals 7 and 8 of relay 125 to be connected through line 166, contact 142 and line 159 to the second side of winding 137 with the result that coil 141 is energized. Solenoid valve 135 is also energized at 24 volts by virtue of the connection of its terminal 2 through line 169, closed contact 139, line 166, closed contact 142 and lines 159 and 158 to the second side of winding 137.

The energization of valve 135 actuates plunger 72 of clamping mechanism 36 to hold member 17 in position.

Motor 127, which is now energized at 110 volts by virtue of the connection of terminal 121A through fuse 122, switch 123, line 149, closed contact 143, line 165, closed contact 138 and line 167 to terminal 146, begins to turn shaft 147 whereupon switches 133 and 134 are closed by cams 128 and 129. At the same time, cam 131 operates means such as a micro switch 133A or the like, which in turn may actuate a solenoid air valve 133B which actuates ram cylinder 34 to initiate the shearing and driving operation of mechanism 35. At a later appropriate time cam 132 operates in like manner a micro switch 134A and additional air valves 134B to operate clip advance mechanism 97.

The closing of switch 133 by cam 128 produces a parallel path of excitation to motor 127, and the closing of switch 134 by cam 129 adds a connection between busses 162 and 163 in parallel with the connection first made by brushes 91 and 92. These parallel connections assure that motor 127 and relays 125 and 126 will remain energized throughout the 0.8 second clip driving cycle of the clip driving mechanism even though brushes 91 and 92 may momentarily break contact. Continuation and completion of the complete operating cycle is thus assured. Once the time delay period of relay 125 is completed, however, its contacts will open, de-energizing valve 135 to release clamping mechanism 36. Then, at the completion of one rotation of motor 127, cam 128 will open switch 133, and cam 129 will open switch 134. Frame member 17 is now free again to move leftward along rail 32. Brushes 91 and 92 sustain the short across busses 162 and 163 until they ride over the next insulator strip 84, at which time contact is broken at brushes 91 and 92, so that relay 126 is de-energized and contacts 142 and 143 open. As a consequence, relay 125 and motor 127 are also de-energized and the control system 120 is thus reset to its starting condition. Member 17 continues to move leftward until brushes 91 and 92 move off strip 84 and initiate another cycle of operation identical to the one just described.

While in the present implementation of the device 30 the frame member is fed manually, it will be readily apparent that automatic feed may readily be accomplished by any of a number of arrangements. A completely automatic device for the realization of the stated objects of the inventions is thus provided, and although but a single embodiment has been illustrated and described, it will be apparent to those skilled in the art that various changes and modifications may be made therein without departing from the spirit of the invention or from the scope of the appended claims.

I claim:

1. An automatic driving mechanism for attaching clips used for securing one end of a spring to a furniture frame member comprising:

a frame, a rail assembly mounted on said frame for guiding an elongated piece of lumber across said frame, means mounted on said frame for supporting a strip of sequentially interconnected clips, piston means for reciprocally moving laterally to and from said rail assembly, clip feeding means for moving the free end of said strip of clips longitudinally of said rail assembly with the foremost clip fed in front of said piston means, said piston means shearing a clip from said strip and sequentially driving it into the piece of lumber, circuit means comprising a portion mounted to extend longitudinally of said rail assembly, means movable along at least a part of said rail assembly and actuated by a piece of lumber moving therealong for periodically completing during its movement an electrical circuit through said circuit means, the completion of said circuit actuating said piston means for engaging a clip moved into its path of movement, shearing it from the strip of clips, and driving it laterally across at least a part of said rail assembly into the piece of lumber moved along said rail assembly into the path of movement of the severed clip.

2. The automatic driving mechanism set forth in claim 1 wherein:

said means mounted on said frame comprises a reel for rotatably supporting a coiled strip of said sequentially interconnected clips.

3. The automatic driving mechanism set forth in claim 1 in further combination with:

clamping means adjacent said piston means energized upon the completion of said circuit for clamping the piece of lumber against said rail assembly during the time the severed clip is driven thereinto by said piston.

4. The automatic driving mechanism set forth in claim 1 wherein:

said means movable along said rail assembly periodically completes the electric circuit through said circuit means to actuate said piston means to drive a clip, and interrupts said circuit to cause retraction of said piston means.

5. The automatic driving mechanism set forth in claim 1 wherein:

said means movable along said rail assembly comprising a car reciprocally movable on said rail assembly.

6. An appartatus for attaching clips used for securing one end of a spring to a furniture frame member comprising:

a frame, a rail assembly mounted on said frame for guiding an elongated piece of lumber across said frame, a first means mounted on said frame for supporting a strip of sequentially interconnected clips, piston means for reciprocally moving laterally to and from said rail assembly, clip feeding means for moving the foremost clip at the free end of said strip of clips in front of said piston means, said piston means shearing a clip from said strip and sequentially driving it into the piece of lumber, control means mounted along said rail assembly, a second means movable along at least a part of said rail assembly and actuated by a piece of lumber moving therealong for periodically actuating during its movement said control means, the actuation of said control means actuating said piston means for engaging a clip moved into its path of movement, shearing it from the strip of clips, and driving it laterally across at least a part of said rail assembly into the piece of lumber moved along said rail assembly into the path of movement of the severed clip.

* * * * *